US006263548B1

(12) United States Patent
Ikeda

(10) Patent No.: US 6,263,548 B1
(45) Date of Patent: Jul. 24, 2001

(54) BUCKLE WITH REDUCED SIZE

(75) Inventor: Yasuhiko Ikeda, Toyonaka (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 09/406,122

(22) Filed: Sep. 27, 1999

(30) Foreign Application Priority Data

Oct. 1, 1998 (JP) ..... 10-280330

(51) Int. Cl.[7] ..... A44B 11/25

(52) U.S. Cl. ..... 24/625; 24/616; 24/633; 24/621

(58) Field of Search ..... 24/625, 615, 616, 24/632, 633, 621

(56) References Cited

U.S. PATENT DOCUMENTS 5,131,122 * 7/1992 Lavato ..... 24/625
5,465,472 * 11/1995 Matoba ..... 24/625
5,774,956 * 7/1998 French et al. ..... 24/625
5,794,316 * 8/1998 Anscher ..... 24/625

FOREIGN PATENT DOCUMENTS

2226129 * 11/1974 (FR) ..... 24/616

* cited by examiner

*Primary Examiner*—Victor N. Sakran
(74) *Attorney, Agent, or Firm*—Kanesaka & Takeuchi

(57) ABSTRACT

A buckle of the invention is formed of a hollow female member, which is provided with an inserting hole and first engaging portions, and a male member provided with a collar portion and elastic pieces disposed at both end portions of a front surface of the collar portion. Each of the elastic pieces includes a second engaging portion at a distal end thereof, and the elastic pieces are disposed to face each other and inserted into the inserting hole of the female member. The both end portions of the front surface of the collar portion are respectively provided with concave portions, so that the collar portion and the elastic pieces are overlapped in a longitudinal direction thereof. Accordingly, an entire length of the male member is shortened while a length of the elastic piece and bending margin are obtained as required. Thus, the entire length of the buckle formed by connecting the female member and the male member does not become too long relative to the width thereof to thereby match the balance between the length and the width of the buckle.

4 Claims, 5 Drawing Sheets

BUCKLE WITH REDUCED SIZE

BACKGROUND OF THE INVENTION AND RELATED ART STATEMENT

The present invention relates to a buckle which is formed of a female member and a male member detachably connected to each other, and attached at two ends of, for example, a belt or a strap.

A conventional buckle as described above is formed of a female member in a hollow cylindrical shape, which is provided with an inserting hole and stopping portions, and a male member including elastic pieces, which are disposed at both end portions of a front surface of a collar portion to face each other. The elastic pieces are inserted into the inserting hole of the female member, and distal ends of the elastic pieces are provided with engaging portions for engaging the stopping portions of the female member.

A flat and hollow member or cylinder constituting the female member is opened at a front surface thereof to form the inserting hole thereat, and openings are formed in upper and lower or side walls of the hollow member to form the stopping portions. Also, a rear end of the hollow member is provided with an attaching mechanism for attaching or fixing an end of the belt or the like.

Further, the collar portion of the male member is provided with an attaching mechanism for attaching or fixing an end of the belt or the like.

And, the elastic pieces are disposed to project from the front surface of the collar portion.

Next, operations of attaching and detaching the conventional buckle will be explained.

Firstly, both ends of the belt are attached to the female member and the male member by utilizing the attaching mechanisms. Then, when the engaging portions of the male member are inserted into the hollow member of the female member, i.e., into the inserting hole, the respective engaging portions abut against the inner sides of the upper and lower walls of the hollow member, and the elastic pieces are bent inwardly. Accordingly, the elastic pieces can be inserted into the hollow member.

Then, when the elastic pieces with the engaging portions are inserted into the hollow member until the collar portion abuts against the hollow member, the respective engaging portions face the openings, so that the engaging portions enter into the openings by urging force of the elastic pieces to thereby engage the stopping portions which constitute front rims forming the openings. As a result, the male member and the female member are connected.

Also, in case of separating the female member and the male member, fingers of an operator are placed at the openings to push the engaging portions, so that the elastic pieces are bent. Accordingly, the engagements between the respective engaging portions and the stopping portions are released, and in this condition, the female member and the male member are respectively moved in the directions away from each other, so that the male member and the female member can be separated.

Incidentally, for example, the buckle as described above was disclosed in Japanese Patent Publication (KOKAI) No. S59-82803.

In the male member of the conventional buckle, the elastic pieces project from the front surface of the collar portion.

Therefore, in case the belt is wide, even if an entire length of the buckle formed by connecting the female member and the male member is long, a balance between the width in a vertical direction of the buckle and the entire length thereof in a lateral direction is matched.

However, even if the belt is narrow, since it is required to form a bending margin of the elastic piece, a length of the elastic piece can not be shortened. Thus, the entire length of the buckle formed by connecting the female member and the male member can not be shortened. Therefore, a balance between the width in the vertical direction of the buckle and the entire length thereof in the lateral direction is not matched. Accordingly, there has been a problem that the buckle becomes long, i.e., too long in the lateral or longitudinal direction relative to the vertical direction.

The present invention has been made to solve the above problem, and an object of the invention is to provide a buckle, wherein in case a belt or the like becomes narrow in width, the entire length of the male member is shortened while obtaining a sufficient length for the elastic piece and bending margin thereof, so that the entire length of the buckle formed by connecting the female member and the male member is not too long relative to the width thereof, resulting in maintaining or matching the balance between the entire length of the buckle and the width thereof.

Further objects and advantages of the invention will be apparent from the following description of the invention.

SUMMARY OF THE INVENTION

To achieve the aforementioned object, the present invention provides a buckle, which is formed of a female member in a hollow shape provided with an inserting hole and stopping portions, and a male member including elastic pieces, which face each other and are disposed at both end portions of a front surface of a collar portion. The elastic pieces are inserted into the inserting hole of the female member, and distal ends of the elastic pieces are provided with engaging portions for engaging the stopping portions of the female member. Also, concave portions are formed at both the end portions of the front surface of the collar portion. Each concave portion is partly surrounded by the elastic piece and the front surface, so that the collar portion and the elastic piece are overlapped in the longitudinal direction.

Since each concave portion provides an additional length to each elastic piece, the elastic piece can bend inwardly in case a distance from a forward end of the elastic piece to a front surface of the collar portion is short, i.e. the length is short for bending the elastic piece sufficiently inwardly. Thus, the length of the male member, i.e. entire length of the buckle, can be shortened.

The female member may further include guide projections between the engaging portions, and the male member may further include a guided portion between the elastic pieces. The guided portion engages the guide projections for guiding the male member to the female member.

DETAILED DESCRIPTION OF A PREFERRED EMBODIMENT

Hereinafter, an embodiment of the invention will be explained with reference to the attached drawings.

Figure 1:
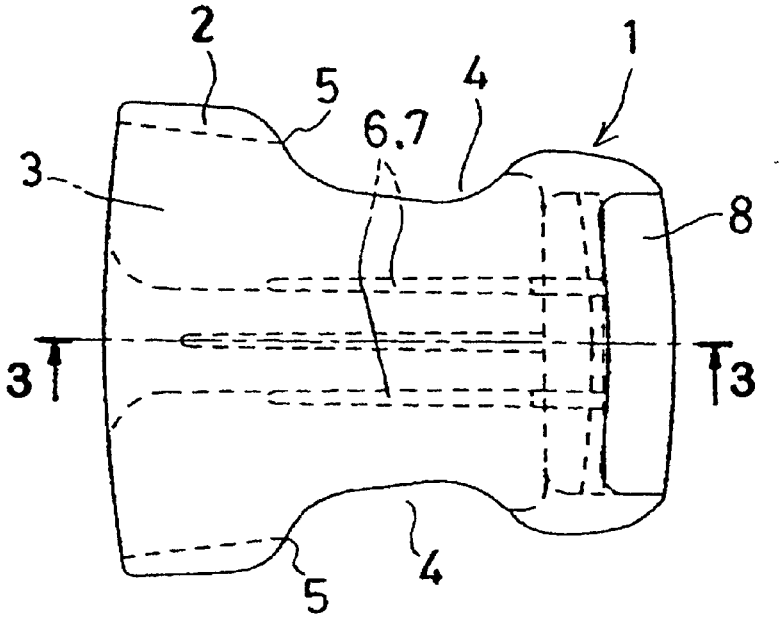
FIG. 1 is a front view of a female member forming a buckle of an embodiment of the present invention.
Figure 2:
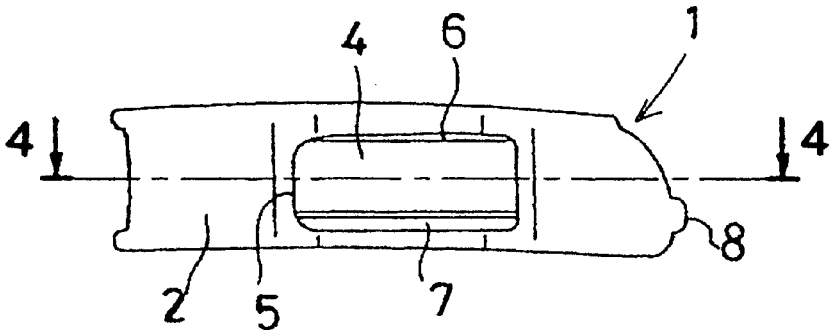
FIG. 2 is a side view of the female member shown in FIG. 1.
Figure 3:
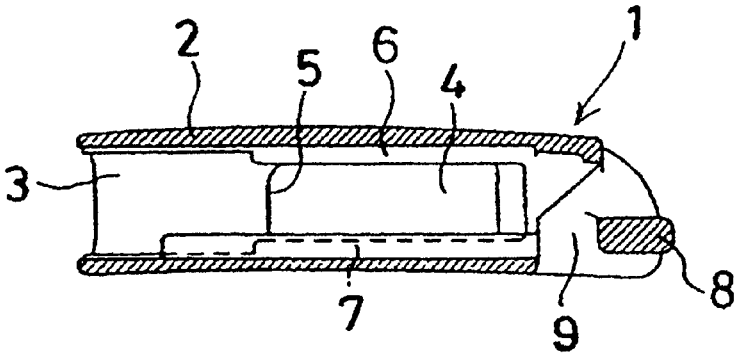
FIG. 3 is a sectional view taken along line 3—3 in FIG. 1.
Figure 4:
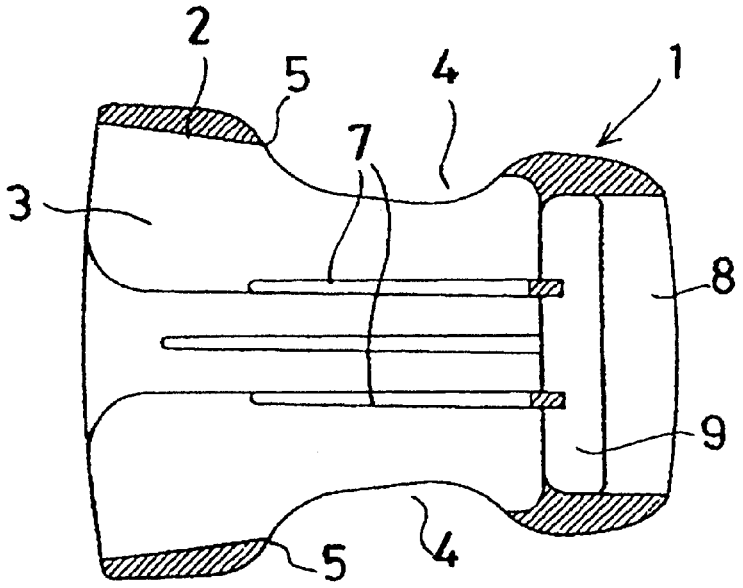
FIG. 4 is a sectional view taken along line 4—4 in FIG. 2.

FIG. 1 is a front view of a female member forming a buckle of an embodiment of the present invention; FIG. 2 is a side view of the female member shown in FIG. 1; FIG. 3 is a sectional view taken along line 3—3 in FIG. 1; and FIG. 4 is a sectional view taken along line 4—4 in FIG. 2.

In FIG. 1 through FIG. 4, numeral 1 designates a female member formed of plastics, and the female member 1 comprises a flat hollow portion or cylinder 2 and a flat plate portion 8 connected to a rear end (right end in the figure) of the hollow member 2 to extend in a vertical direction in the figure.

The hollow member 2 is opened from a front surface thereof to the rear end to form an inserting hole 3 therein, and openings 4 are formed in upper and lower or side walls of the hollow member 2, wherein front rims of the openings 4 constitute stopping or engaging portions 5.

And, two guide ribs 6 are provided continuously on an inner surface of a front wall of the hollow cylinder 2, and two guide ribs 7 are provided continuously on an inner surface of a rear wall of the hollow cylinder 2 to correspond to the guide ribs 6. The guide ribs 6 and 7 are connected at rear ends thereof to form a stopper.

Incidentally, a hole 9 for inserting the belt therein is formed between the hollow member 2 and the flat plate portion 8, and the flat plate portion 8 and the hole 9 form an attaching mechanism for attaching the belt.

Also, the female member 1 is formed such that an upper half and a lower half are symmetrical to each other.

Figure 5:
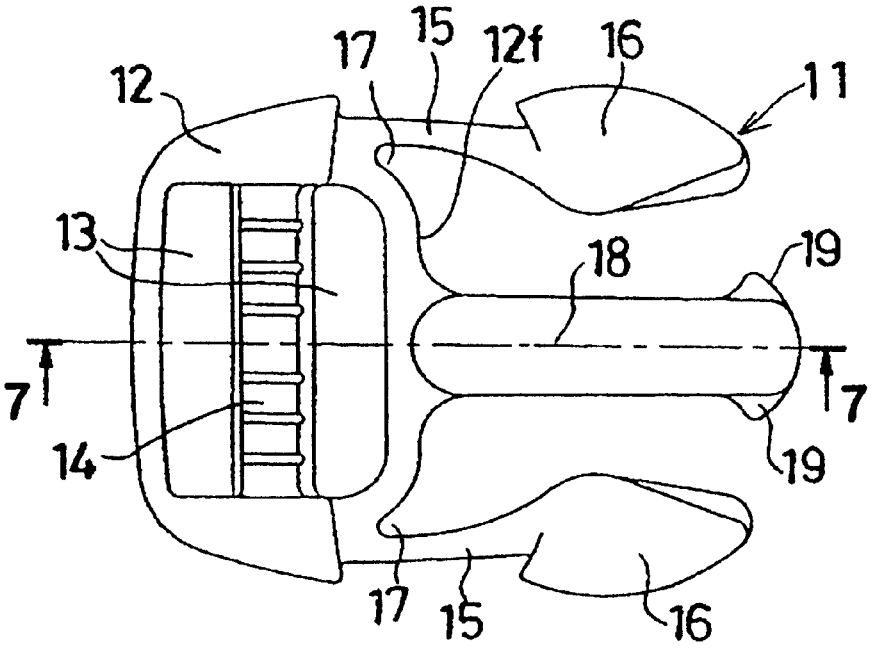
FIG. 5 is a front view of a male member forming the buckle of the embodiment of the present invention.
Figure 6:
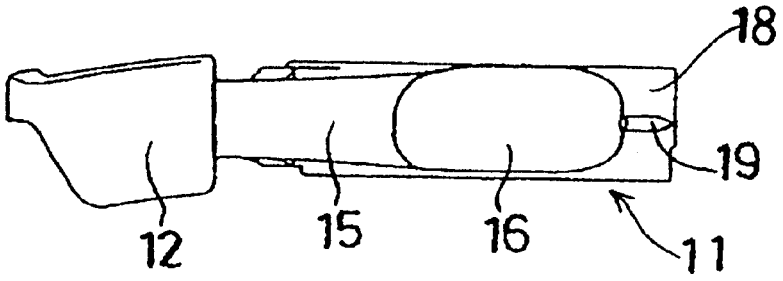
FIG. 6 is a side view of the male member shown in FIG. 5.
Figure 7:
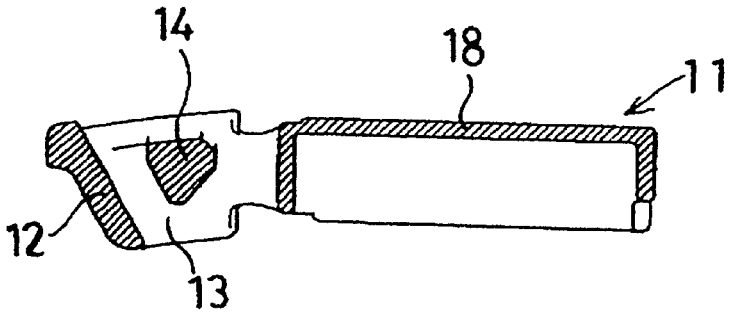
FIG. 7 is a sectional view taken along line 7—7 in FIG. 5.
Figure 8:
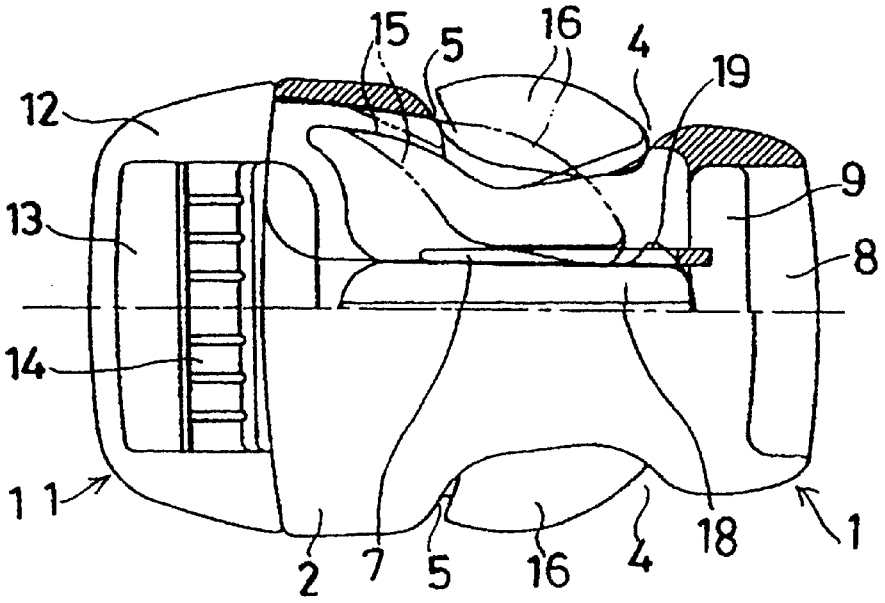
FIG. 8 is a partly sectional front view of the buckle in the condition that the female member and the male member are connected, showing an upper half of the female member in section.

FIG. 5 is a front view of a male member forming the buckle of the embodiment of the present invention; FIG. 6 is a side view of the male member shown in FIG. 5; FIG. 7 is a sectional view taken along line 7—7 in FIG. 5; and FIG. 8 is a partly sectional front view of the buckle in the condition that the female member and the male member are connected, showing an upper half of the female member in section.

In FIG. 5 through FIG. 8, numeral 11 designates a male member formed of plastics. The male member 11 is formed of a collar portion 12; elastic pieces 15 connected at both end portions of a front surface 12*f* of the collar portion 12 to extend forward, i.e. toward right in the figure, to be inserted into the inserting hole 3 of the hollow member 2; and a guided portion 18 connected to a center of the front surface 12*f* of the collar portion 12 to extend forward and to be inserted into the inserting hole 3 of the hollow member 2.

The collar portion 12 is provided with a hole 13 passing therethrough in a fore-to-aft direction or in a direction of a thickness thereof, and a shaft 14 to divide the hole 13 into right and left.

The hole 13 and the shaft 14 constitute an attaching mechanism for attaching or fixing the belt.

Also, engaging portions 16 having outer rear ends engaging the stopping portions 5 of the hollow member 2 are respectively connected to the distal ends of the elastic pieces 15.

Further, the respective elastic pieces 15 are disposed outside convex portions 17 formed at the both end portions of the front surface 12*f* of the collar portion 12, and overlapped partly with the collar portion 12 in the longitudinal direction.

The guided portion 18 is guided by the guide ribs 6 and 7 of the hollow member 2 to move forwardly and rearwardly.

And, upper and lower portions of a distal end of the guided portion 18 are integrally provided with abutting portions 19 having distal ends abutting against the stopper (guide ribs 6 and 7) in the condition that the collar portion 12 abuts against the hollow member 2.

Incidentally, the male member 11 is formed such that an upper half and a lower half are symmetrical to each other.

Next, operations of attaching and detaching the buckle will be explained.

Firstly, both end portions of the belt are attached to the female member 1 and the male member 11 by utilizing the attaching mechanisms. Then, when the engaging portions 16 of the male member 11 are inserted into the hollow member 2, i.e. inserting hole 3, the engaging portions 16 abut against the inner surfaces of the upper and lower walls of the hollow member 2, so that the elastic pieces 15 are respectively bent inwardly. Thus, the engaging portions 16 and the elastic pieces 15 can be inserted into the hollow member 2.

Then, when the engaging portions 16 and the elastic pieces 15 are further inserted into the hollow member 2 to become a condition such that the collar portion 12 abuts against the hollow member 2, i.e. the condition shown in FIG. 8, the engaging portions 16 respectively face the openings 4 as shown by a two-dotted chain line in FIG. 8. Thus, as shown by a solid line in FIG. 8, the respective engaging portions 16 are rushed into or enter the corresponding openings 4 by urging forces of the elastic pieces 15 to engage the stopping portions 5. Accordingly, the female member 1 and the male member 11 are connected such that the male member 11 does not come out from the female member 1.

Also, in case of separating the female member 1 and the male member 11, fingers of an operator are placed at the respective openings 4 to push the engaging portions 16 so that the elastic pieces 15 are bent. Accordingly, the engagements between the respective engaging portions 16 and the corresponding stopping portions 5 are released, and in this condition, the female member 1 and the male member 11 are relatively moved in the direction away from each other, so that the female member 1 and the male member 11 can be separated.

Figure 9:
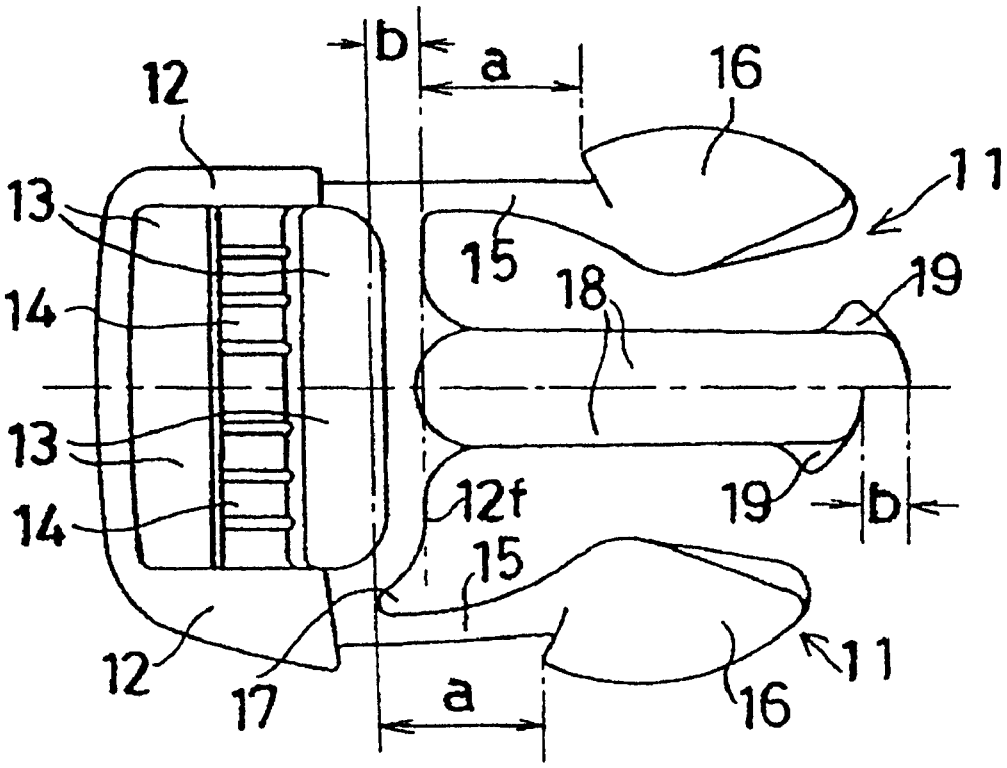
FIG. 9 is an explanatory front view for comparing a length of the male member of the invention to a length of a male member of a conventional buckle, wherein an upper half of the view shows the male member of the conventional buckle and a lower half of the view shows the male member of the invention.

FIG. 9 is an explanatory view for comparing a length of the male member of the embodiment of the invention to a length of a male member of a conventional buckle.

Incidentally, a lower half of the view shows the male member of the embodiment of the invention, and an upper half of the view shows the male member of the conventional buckle.

Also, in the male member of the conventional buckle, the same numbers as in the present embodiment are used for designating the same components.

In FIG. 9, a designates a length of the elastic piece 15 which is required for retreating or bending the engaging portion 16, and b designates an overlapped length in which the collar portion 12 and the elastic piece 15 are overlapped in the longitudinal direction.

As described above, according to the embodiment of the present invention, by providing the concave portions 17 at both end portions of the front surface 12*f* of the collar portion 12 to be partly surrounded by the elastic pieces 15, the collar portion 12 and the elastic piece 15 are partly overlapped in the longitudinal direction as shown in FIG. 9. The length of the male member 11 can be shortened in the longitudinal direction for the overlapped length b in which the collar portion 12 and the elastic piece 15 are overlapped, so that the entire length of the buckle in the connected condition can be shortened.

Therefore, in case the belt is narrow, by shortening the entire length of the male member 11 while the length of the elastic piece 15 and the bending margin are maintained as required, the entire length of the buckle formed by connecting the female member 1 and the male member 11 does not become too long with respect to the width thereof. Accordingly, a balance between the width of the buckle and the entire length thereof can be matched.

Incidentally, as the depth of the concave portion 17 becomes deeper, the overlapped length b becomes longer, so that the entire length of the male member 11 and the entire length of the buckle to can be further shortened.

As described above, according to the present invention, by providing the concave portions at both end portions of the front surface of the collar portion to be partly surrounded by the elastic pieces, the collar portion and the elastic piece are overlapped in the longitudinal direction thereof. Thus, the length of the male member can be shortened for the overlapped length in which the collar portion and the elastic piece are overlapped, so that the length of the buckle in the connected condition can be shortened. Therefore, in case the belt is narrowed, by shortening the entire length of the male member while the length of the elastic piece and the bending margin are maintained as required, the entire length of the buckle formed by connecting the female member and the male member does not become too long with respect to the width thereof. Accordingly, a balance between the width of the buckle and the entire length thereof can be matched.

While the invention has been explained with reference to the specific embodiment of the invention, the explanation is illustrative and the invention is limited only by the appended claims.

What is claimed is:

1. A buckle comprising:

a female member having a hollow shape and including an inserting hole at a front side and first engaging portions at lateral sides relative to the front side, and a male member detachably connected to the female member, and including a collar potion; elastic pieces extending from front lateral end portions of the collar portion to be inserted into the inserting hole of the female member, each of said elastic pieces having a second engaging portion engaging each of the first engaging portions of the female member; and concave portions formed at the front lateral end portions to be partly surrounded by the elastic pieces so that the collar portion and the elastic pieces are partly overlapped in a longitudinal direction of the male member, each of the concave portions providing an additional length to each of the elastic pieces so that the elastic piece can bend inwardly in case a distance from a forward end of the elastic piece to a front surface of the collar portion does not permit the elastic piece to bend inwardly for engaging the first and second engaging portions.

2. A buckle according to claim 1, wherein said female member further includes guide projections between the first engaging portions, and said male member further includes a guided portion between the elastic pieces, said guided portion engaging the guide projections for guiding the male member to the female member.

3. A buckle according to claim 1, wherein said female member includes openings at side walls thereof, said first engaging portions being formed at edge portions of the openings as stopping portions.

4. A buckle according to claim 3, wherein the female member and the male member are respectively provided with attaching mechanisms to be attached to ends of a string member.

* * * * *